United States Patent [19]

Geiger et al.

[11] 4,303,205

[45] Dec. 1, 1981

[54] AGITATOR MILL AND METHOD OF CONTROLLING THE SAME

[75] Inventors: Armin Geiger, Bichwil; Kurt Grauer, Degersheim, both of Switzerland

[73] Assignee: Gebruder Buhler AG, Switzerland

[21] Appl. No.: 68,852

[22] Filed: Aug. 22, 1979

[30] Foreign Application Priority Data

Aug. 24, 1978 [CH] Switzerland ..... 8992/78
May 3, 1979 [CH] Switzerland ..... 4169/79

[51] Int. Cl.[3] ..... B02C 17/16

[52] U.S. Cl. ..... 241/17; 241/23; 241/35; 241/65; 241/171; 241/172

[58] Field of Search ..... 241/17, 33, 35, 36, 241/65, 66, 67, 46 R, 46.11, 46.17, 172, 173, 171, 23, 34, 30

[56] References Cited

U.S. PATENT DOCUMENTS 2,613,878 10/1952 Hailey ..... 241/35

FOREIGN PATENT DOCUMENTS 1077950 3/1960 Fed. Rep. of Germany .
1248440 8/1967 Fed. Rep. of Germany .
2051003 3/1972 Fed. Rep. of Germany .
1038153 8/1966 United Kingdom .
1189178 4/1970 United Kingdom ..... 241/173
1314789 4/1973 United Kingdom ..... 241/172

*Primary Examiner*—Mark Rosenbaum
*Attorney, Agent, or Firm*—Townsend and Townsend

[57] ABSTRACT

An agitator mill for treating a liquid containing material particles for example for dispersing paint pigment in a mixture of solvent and binder basically comprises a milling vessel containing freely movable milling bodies and with an inlet and outlet for said liquid, stirrer mechanism within the milling vessel and an electric stirrer motor for driving the stirrer mechanism. The mill features, for the purpose of obtaining optimum operating efficiency, a control circuit which regulates the stirrer motor current to a constant value by adjustment of a pump supplying the liquid to the milling vessel and/or a volume controller for controlling the volume of milling bodies within the milling vessel or the volume of the milling vessel and a temperature control circuit which controls the operating temperature in the milling vessel to lie at a constant value. Various variants and control possibilities including the use of a computer are set forth together with methods of controlling the agitator mill.

31 Claims, 10 Drawing Figures

AGITATOR MILL AND METHOD OF CONTROLLING THE SAME

Figure 1:
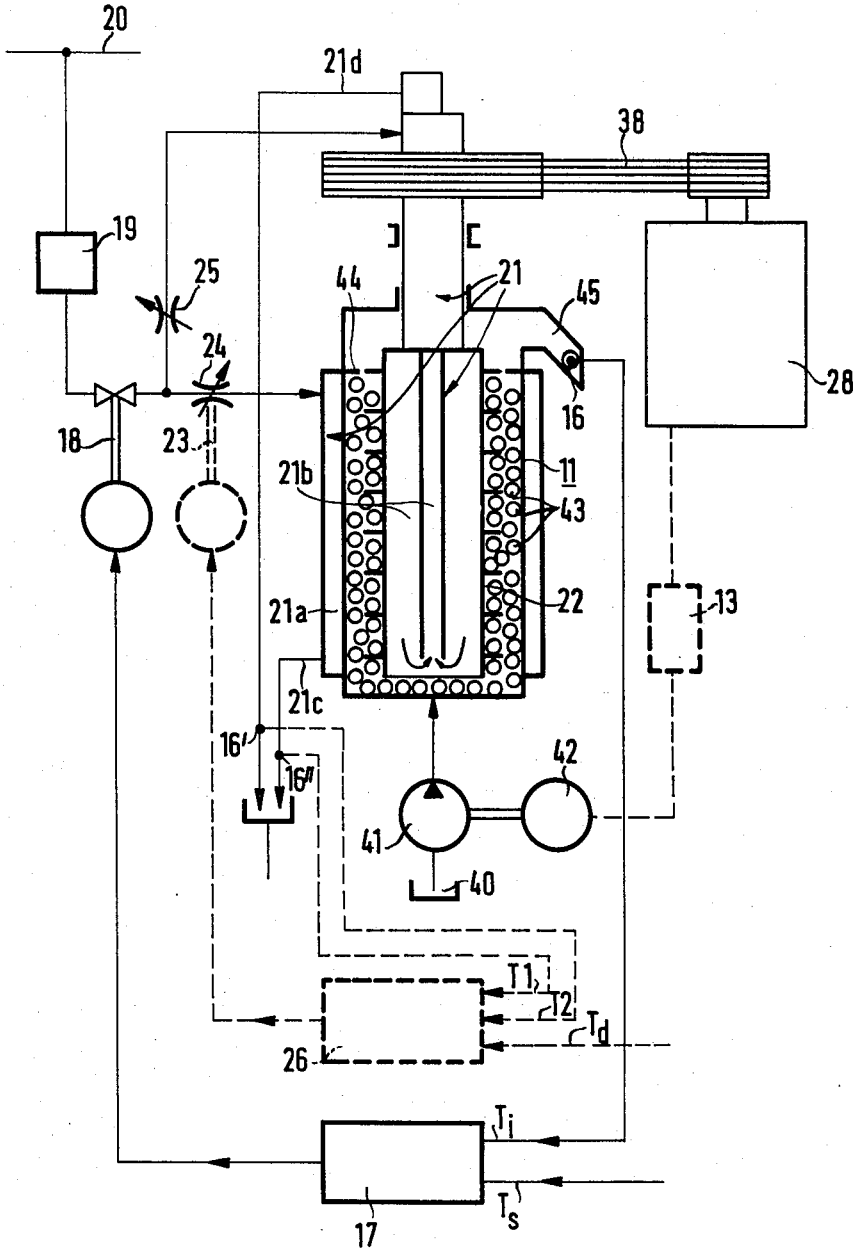

This invention relates to an agitator mill and has particular reference to an agitator mill suitable for treating a liquid containing material particles. An agitator mill of this type typically comprises a milling vessel containing freely movable milling bodies and having inlet and outlet means for liquid containing the material to be treated, a pump for supplying said liquid, stirrer mechanism located within the milling vessel and an electric motor for driving said stirrer mechanism.

Agitator mills of this kind are used for the fine milling, dispersing, homogenising and/or emulsifying of liquid products. Such products are frequently in the form of a slurry.

Agitator mills as set out above are particularly used for carrying out a continuous working process. One specific application of an agitator mill is for the processing of dispersions of colour pigments in a mixture of solvent and binder.

It is a problem with such agitator mills to achieve an optimum adjustment of the various operating parameters for the product to be processed. The operating parameters include such quantities as temperature, supply pressure of the feed pump, throughput, speed of the pump and the stirring mechanism, the volume of the milling vessel and/or the quantity of milling bodies present within the milling vessel (depending on the extent to which these volume parameters are variable). Previously this adjustment of the operating parameters took place manually on the basis of values derived from experience. However in practical operation this approach leads to irregularities as it is frequently necessary for one operator to monitor several mills and because the various operating parameters which need to be adjusted are dependent on one another. For example the hourly throughput depends on the speed and the pressure of the feed pump however it also depends on the viscosity of the product and this once more depends on the temperature of the product. The temperature of the product is however itself once more dependent on the operating conditions within the machine, in particular the resistance to milling, the coefficient of friction and the degree of cooling of the stirrer mechanism and the milling vessel. The product's temperature is also influenced by the speed of the stirrer mechanism.

It is already known to influence the operating condition of a mill for example by holding the viscosity of the product constant by means of the addition of solvent and binder materials. This approach is taught in DE-OS No. 2 546 146.

A further problem in reduction mills resides in the danger of overheating and thus damage to material being milled which has a temperature sensitive nature. A known mill (U.S. Pat. No. 3,945,055) is for this reason provided with a monitoring alarm system which detects specified opeating parameters and also their deviation from specified values. The monitoring and alarm system is able for example to stop the feed pump and/or to initiate an alarm if a specified tolerance for the deviation of a monitored value is exceeded. The alarm signal then draws the attention of an operator to an irregularity in the operation of the mill. In this way various parameters such as for example the pressure in the milling vessel, the pressure of a cooling medium for cooling the mill, the temperature in the milling vessel and the like can be detected. It is however a disadvantage with this known mill that, after the release of an alarm or stopping of the mill, the normal operating condition can only restored by the attention of an experienced operator.

It is also already known in mills to hold the power consumption of the stirrer motor as close as possible to an optimum value. This approach is shown by DE-AS No. 10 77 950, DE-PS No. 12 16 079, DE-AS No. 20 41 172 and DE-PS No. 5 54 440. These prior art teachings concentrate on using the current requirement for the motor for the stirrer mechanism as a control quantity for controlling the supply of material to be milled to the mill. This measure is however not sufficient for optimising the operation of the mill.

It is also already known from DE-AS No. 12 48 440 and DE-PS No. 2 051 003 to adjust the volume of a hollow space filled with milling bodies so as to match the instantaneous motor power. This takes place by the displacement upwardly or downwardly of a solid or sieve-like preferred piston in either the milling vessel or an associated chamber. The movement of the piston can take place with the aid of mechanical, hydraulic or pneumatic devices. This arrangement is also advantageous for simplifying the starting up of a filled mill in the unloaded condition. All known agitator mills have however the disadvantage that the critical parameters such as temperature, loadability of the motors, speeds etc. must be held significantly below a permissable maximum value in order that the necessary and considerable degree of reliability is available when taking into account the possible fluctuations in these parameters.

The principal object of the present invention thus resides in providing an agitator mill of the kind previously described by means of which a constant reproducable quality of the milled product is achieved and which can be continuously operated at the upper limit of the loadability of the stirrer mechanism, of the cooler and also the operating temperature for the material to be milled without the danger of an overload or an excessive demand existing. A further object of the present invention is to reduce the demands that must be placed on operators of the reducing mill.

In accordance with the present invention there is provided an agitator mill suitable for treating a liquid containing particles, the agitator mill comprising a milling vessel containing freely movable milling bodies and having inlet and outlet means for said liquid, a controllable pump for supplying said liquid, stirrer mechanism located within the milling vessel and an electric stirrer motor for driving said stirrer mechanism, there being further provided, in association with the milling vessel, a primary control circuit for the stirrer motor current which controls at least one of the pump and a volume controller for controlling at least one of the volume of milling bodies within the milling vessel and the volume of the milling vessel; and a secondary control circuit for adjusting the cooling in dependence on the temperature in the milling vessel.

In this manner overheating of the material to be milled and overloading of the stirrer motor are avoided, although the temperature and the motor current can lie close to the highest permissable operating limit. The primary control circuit is thus the main influence on holding the temperature in the milling vessel constant. The secondary cooling control circuit operates on the occurrence of temperature changes brought about by fluctuations of the temperature of the material to be milled, of the cooling water and of the surroundings.

The secondary control circuit is also effective on the occurrence of changes of the heat resistivity for example due to changes in the viscosity of the material being milled. Finally the position of the piston of the volume control affects the cooling so that the cooling control circuit has to smooth out the corresponding fluctuations.

It is especially advantageous if a temperature sensor is arranged at the outlet of the milling vessel. The temperature sensor is connected to a temperature controller which also has a desired temperature input and the output of which is effective to increase the cooling if too high an actual temperature is measured and to reduce the cooling if too low an actual temperature is detected. In particular the output signal of the temperature controller can operate a control valve through which the cooling medium for the milling vessel and/or the rotor of the stirrer flows.

It is especially advantageous if cooling circuits are provided for the milling vessel and for the rotor of the stirrer and if the difference between the temperatures in these cooling circuits is automatically controlled. For this purpose a second control valve is conveniently provided which allows individual control of the cooling flow to the milling vessel and the rotor. This second control valve is conveniently connected to a temperature difference controller which receives as input quantities the output temperatures of the milling vessel and rotor cooling circuits and the desired value for the difference between these temperatures.

A first useful practical embodiment of the invention is characterized by means for signalling the actual current of the electric motor for driving the stirrer mechanism to a current controller for this motor. The current controller also has an input to which a signal representative of the desired motor current, is applied. The output from the current controller is applied to a pump speed controller which so controls the pump speed that the stirrer motor current remains constant.

In an agitator mill in which either the milling vessel volume is variable or the volume of milling bodies within the milling vessel is variable a second practical embodiment of the invention envisages that the actual stirrer motor current is signalled to a stirrer motor current controller which has an input for the desired stirrer motor current and the output of which is applied to a volume controller which is adapted to so vary the volume of the milling vessel or the quantity of milling bodies within the milling vessel that the stirring motor control current remains constant.

It is especially advantageous however if the output of the stirrer motor current controller is connected via a distributor to the pump speed controller and to the volume controller. The distributor can advantageously be so constructed that on changing of the desired stirrer motor current first of all the pump speed is changed and, when this has for example reached its maximum value that the piston determining the volume of the milling vessel is moved.

It is especially advantageous if a pressure controller is connected before the pump speed controller and the actual pressure prevailing in the milling vessel is passed to this pressure controller as an input.

Furthermore the pressure controller can also receive the desired pressure as an input value. In this embodiment the pressure in the milling vessel is primarily controlled to hold the stirrer motor current constant by producing a corresponding change of the pump motor speed.

Only when the speed reaches a value which is dangerous for the integrity of the pump does the speed control circuit start. The pressure then sinks below the desired value. The current control then begins when the viscous friction in the pump is very high at start-up or when the speed drops to zero for example by virtue of a stone in the pump.

Preferably the pressure controller is so connected via a switch to the speed controller that a desired pressure signal supplied to the pressure controller or a desired speed signal supplied to the speed controller selectively controls the speed of the pump. The desired speed signal is applied to the speed controller when the switch is open.

If the capacity of the cooling system should be exceeded, and the temperature in the milling vessel should become too high, an advantageous modification of the invention provides for the output of the temperature controller to be connectable via a sequence controller to the pump speed controller and/or the volume controller. Two switches are provided for switching over which shut off the temperature controller from the control valve and connect the temperature controller via the sequence regulator to the pump speed controller or volume controller.

In an especially advantageous form of the invention the stirrer motor is an AC asynchronous motor and is fed through a frequency changer which receives the smallest of a desired speed signal or a desired power signal as its control signal.

Figure 2:
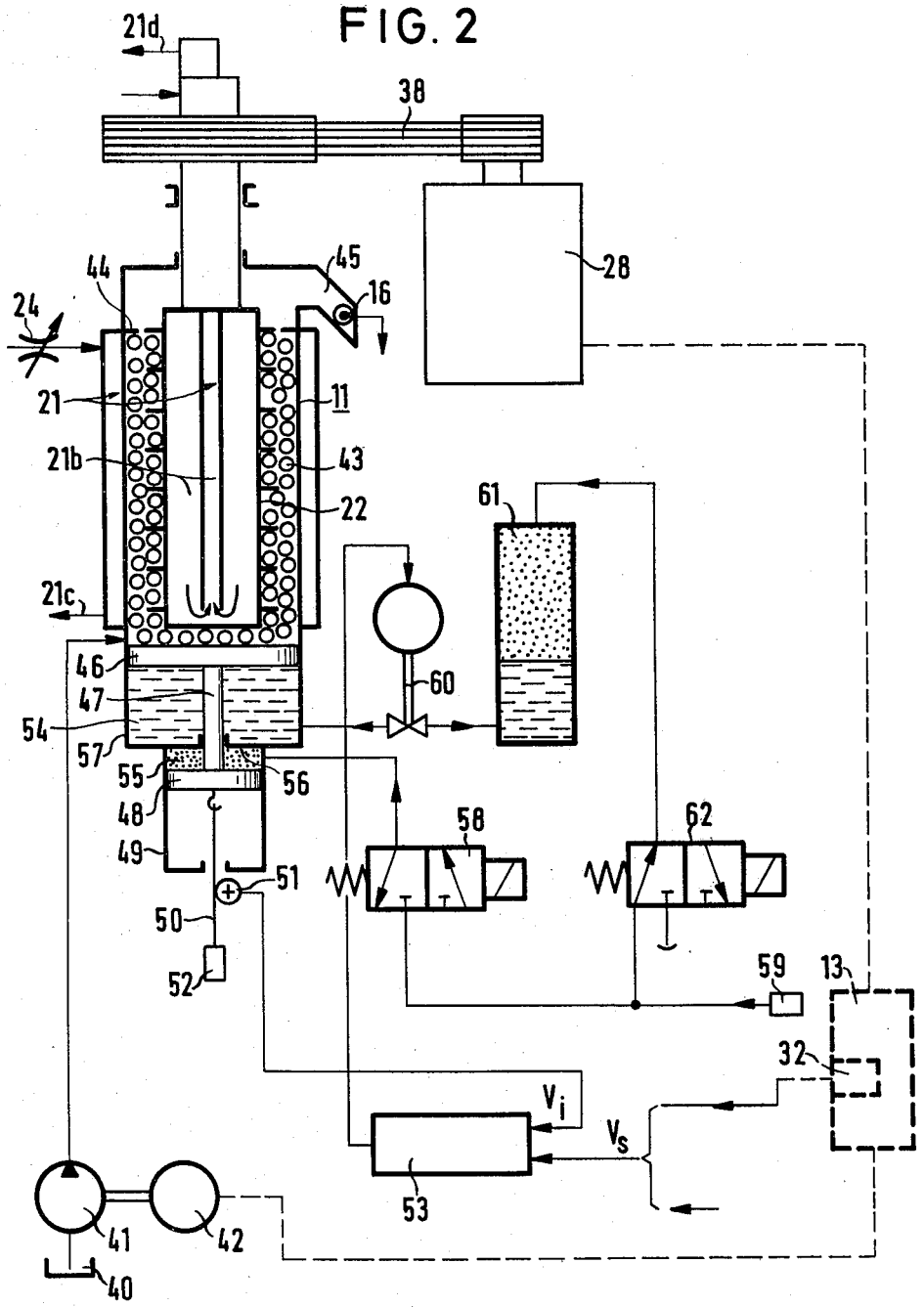
Figure 3:
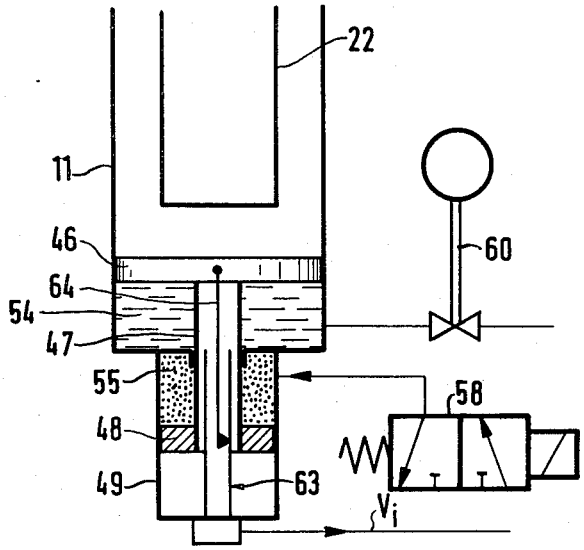
Figure 4:
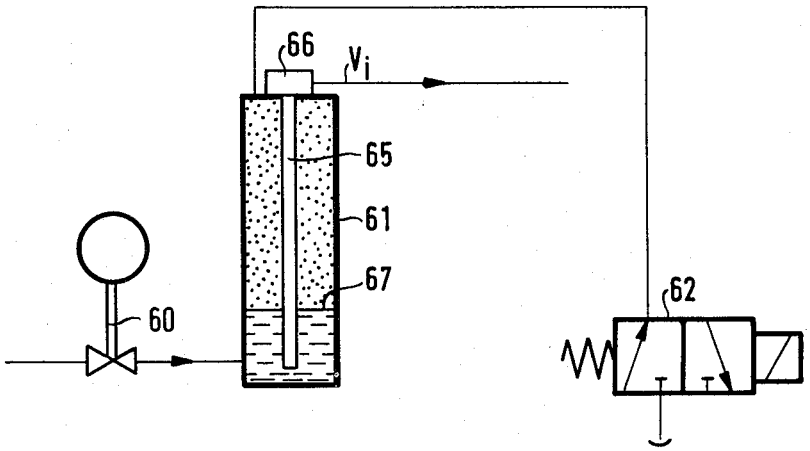
Figure 4A:
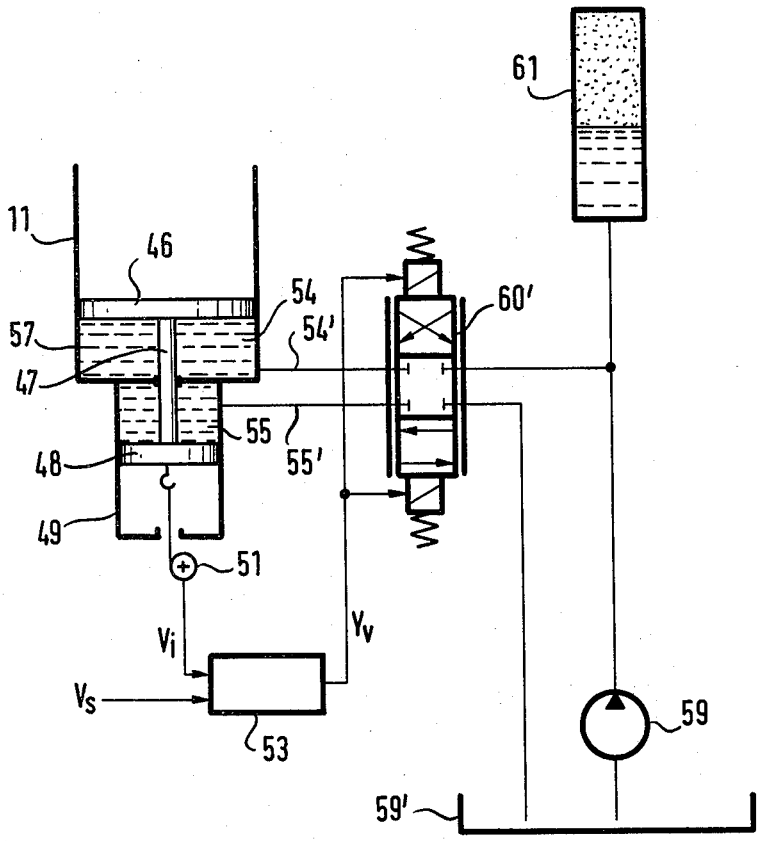
Figure 5:
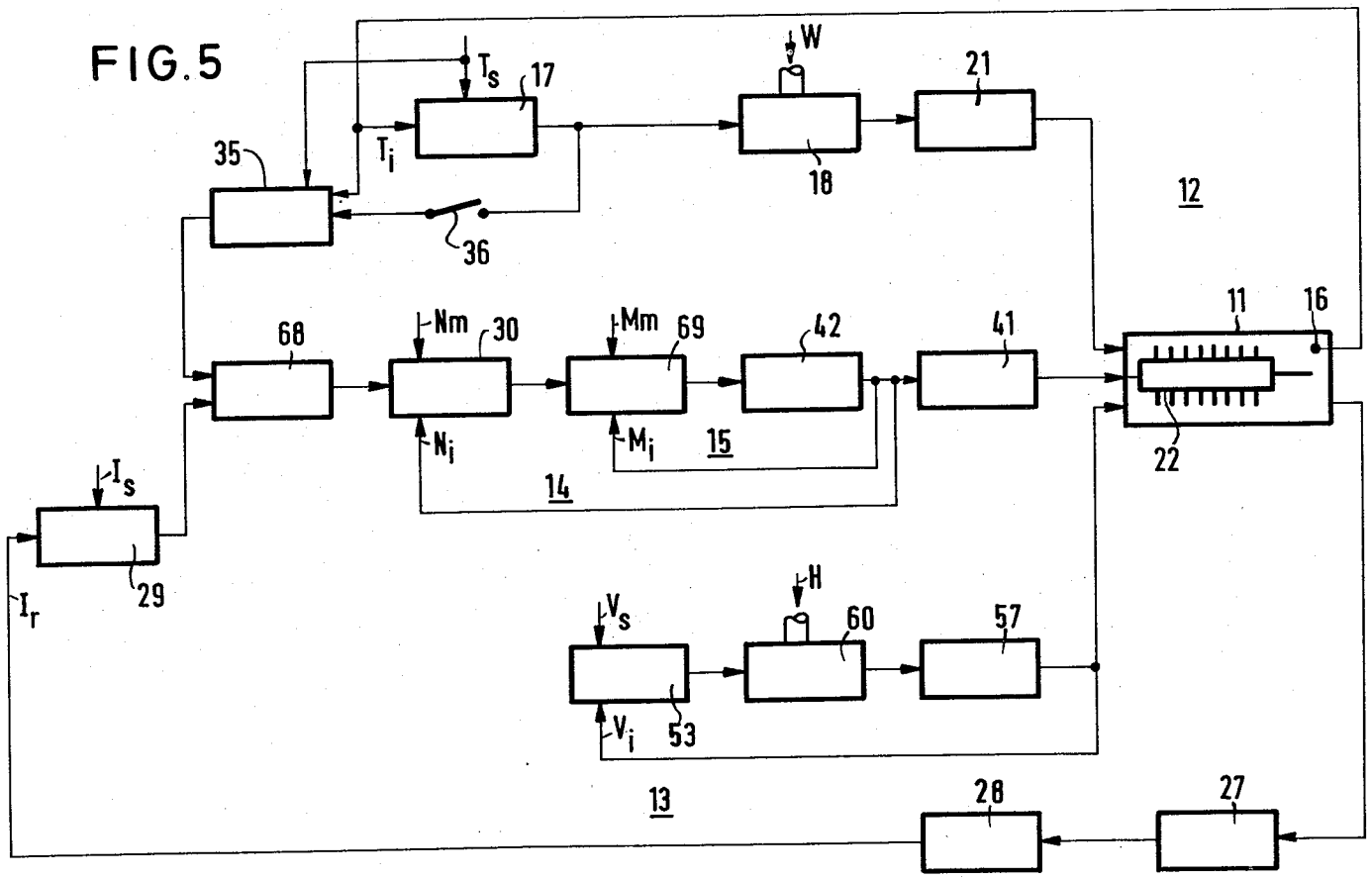
Figure 6:
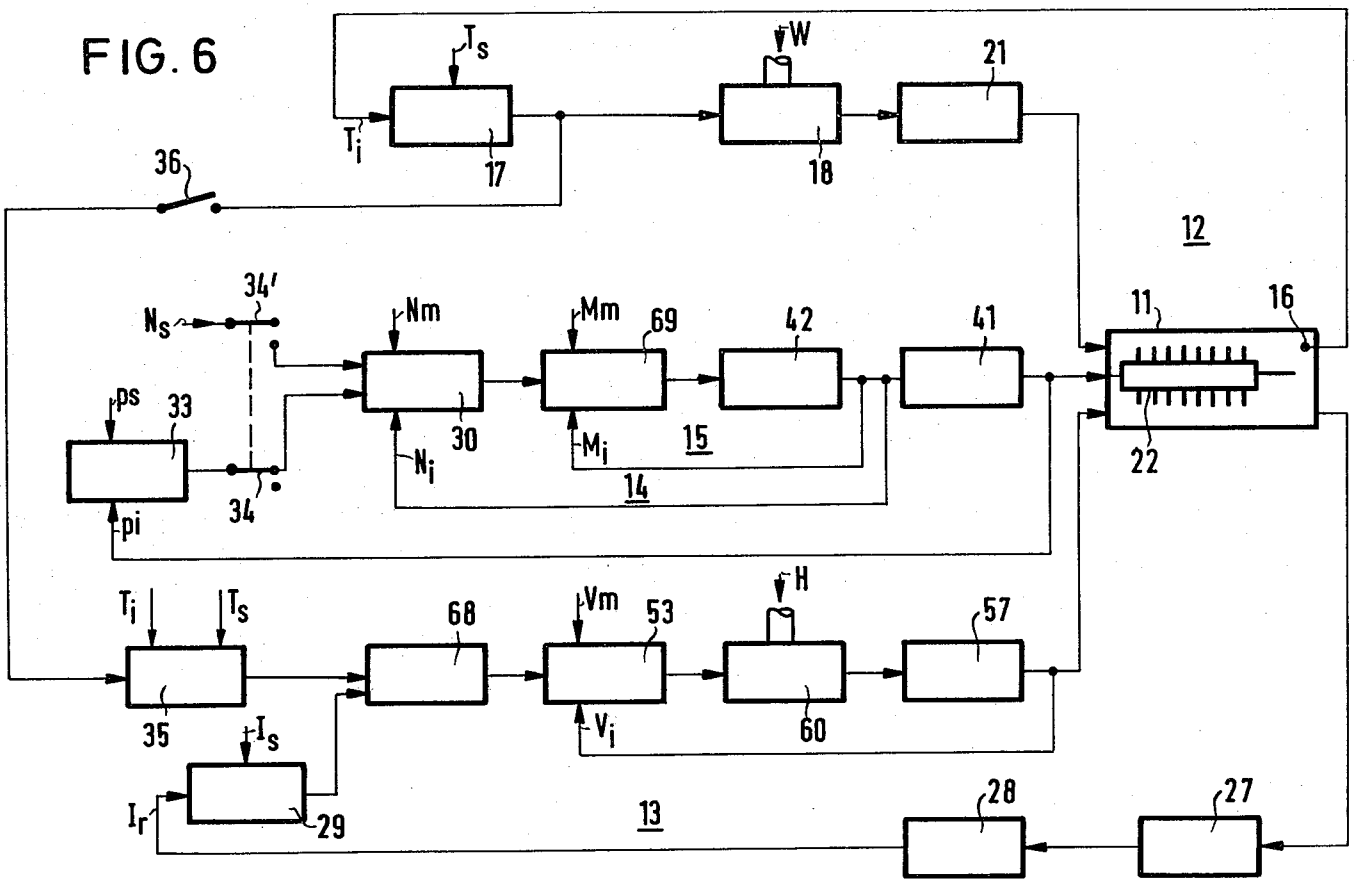
Figure 7:
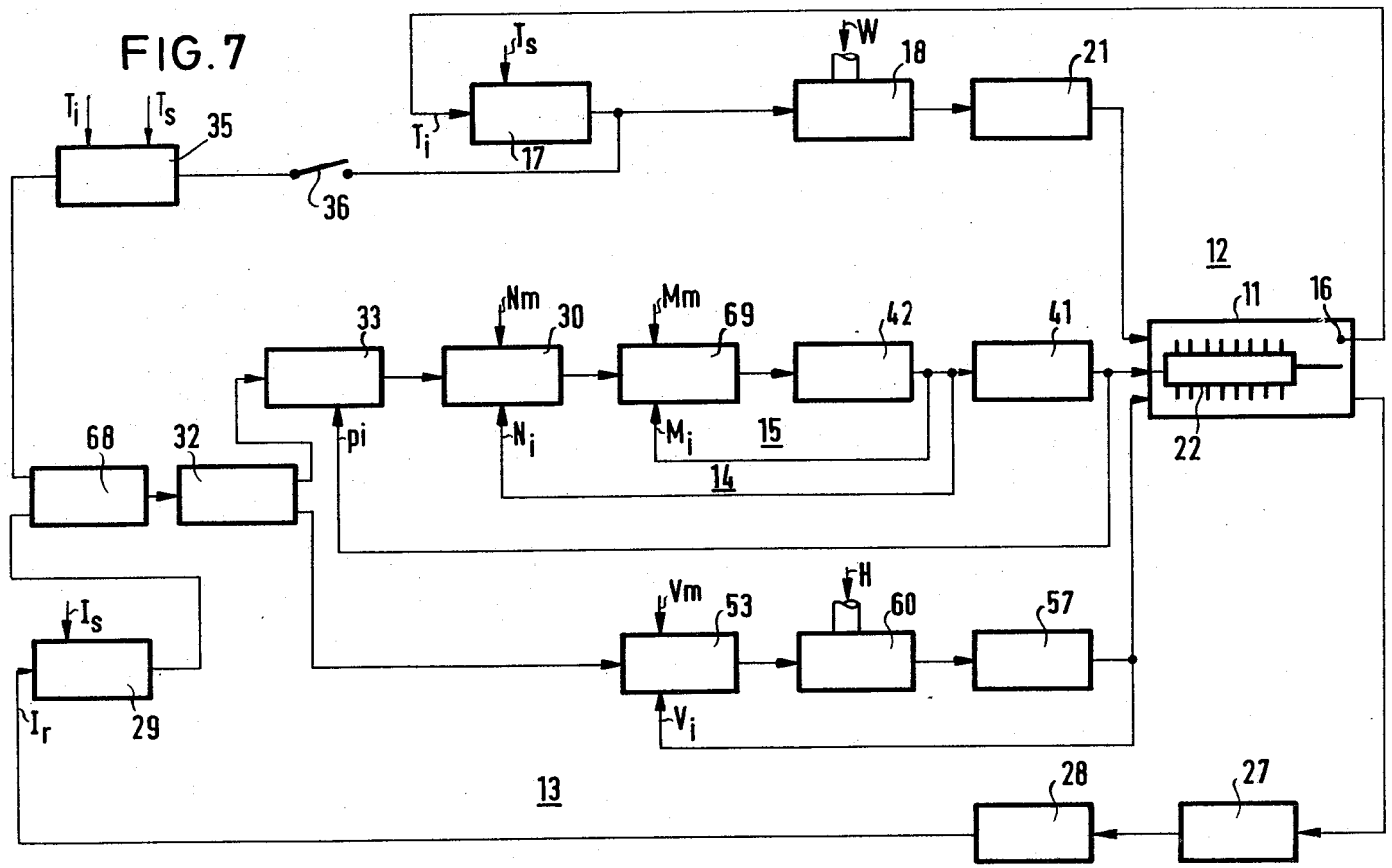
Figure 8:
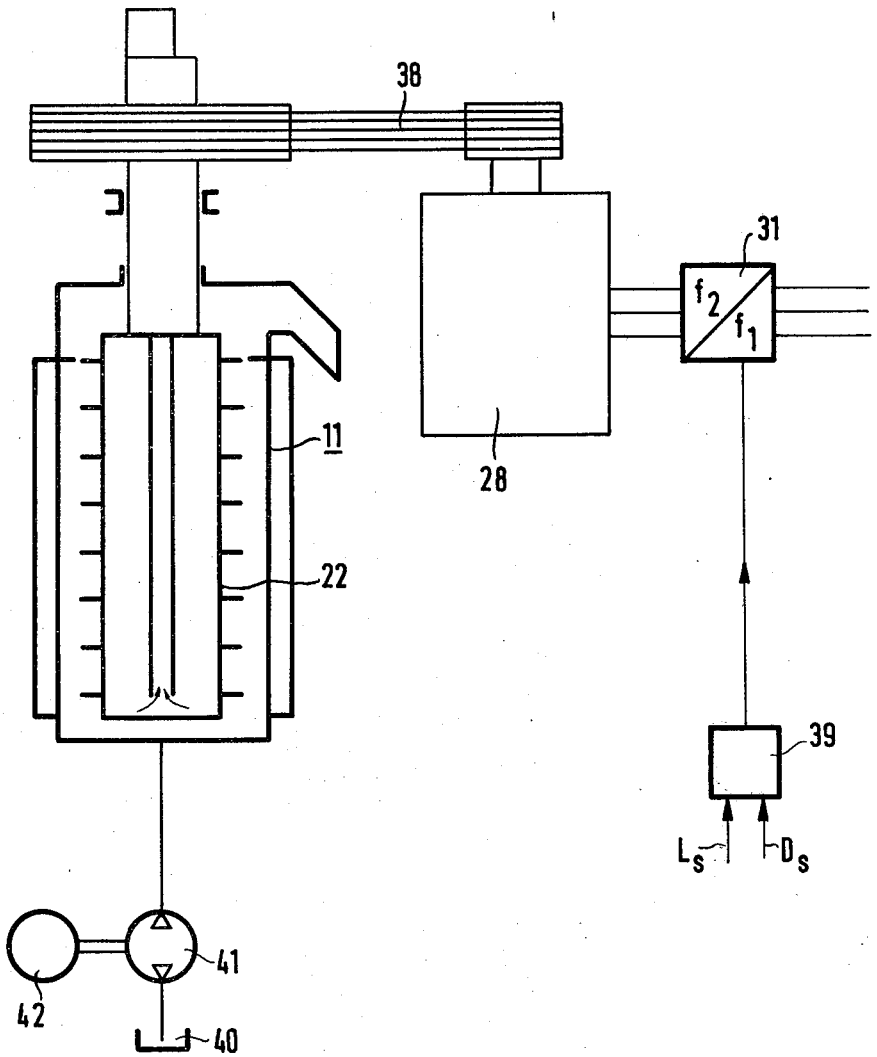
Figure 9:
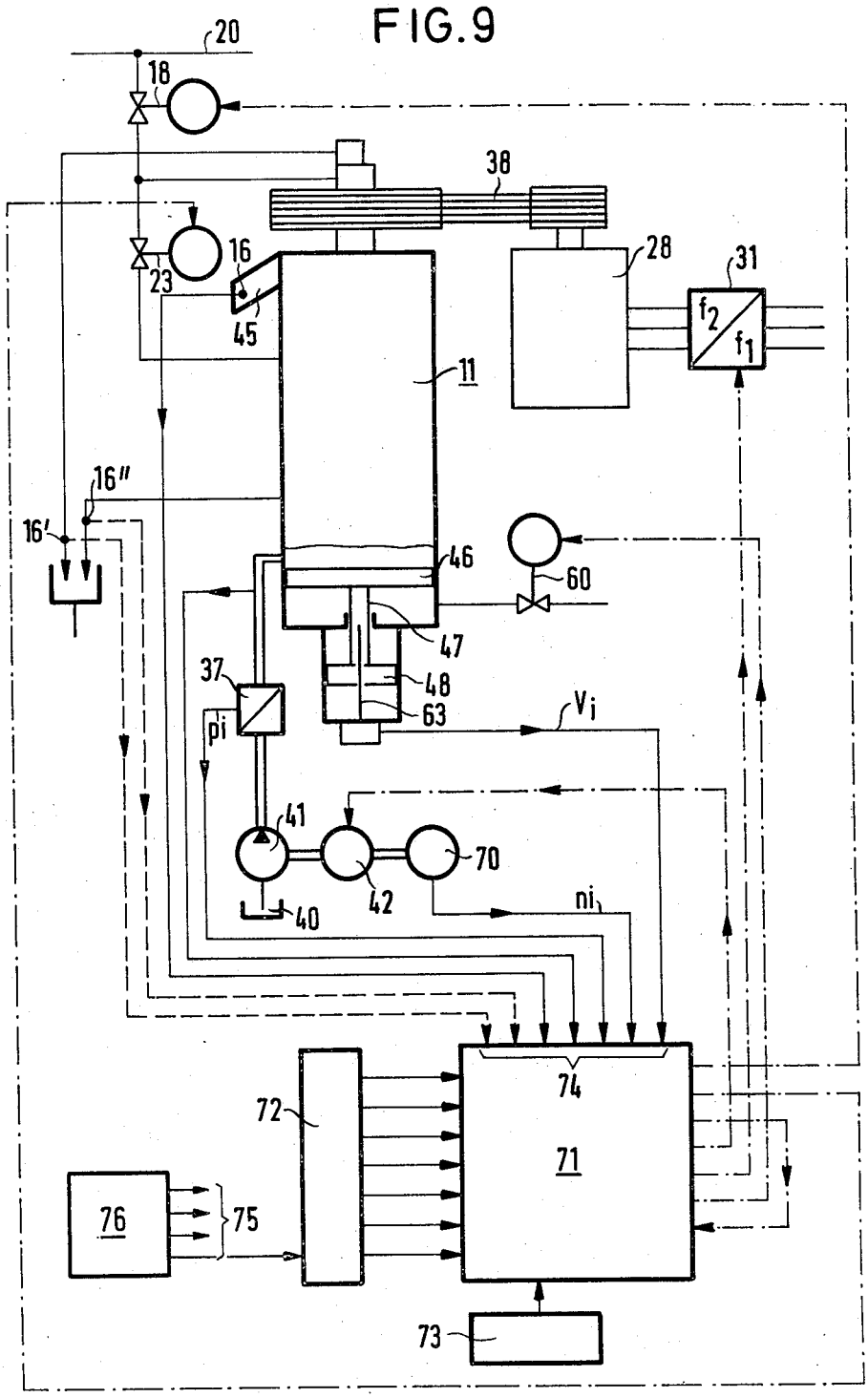

The invention will now be specifically described in more detail by way of example only with reference to the drawings in which are shown:

FIG. 1 a schematic illustration of an agitator mill showing the temperature control circuit for regulating the degree of cooling and which also indicates, in broken lines, the stirrer motor control circuit and the temperature difference control circuit, FIG. 2 a similar view to FIG. 1 for illustrating the volume control of the agitator mill but omitting the temperature control circuit, FIG. 3 a modification of the apparatus for measuring the movement of the volume control piston, FIG. 4 a further possibility for measuring the movement of the volume control piston, FIG. 4*a* a further possibility for effecting volume control, FIG. 5 a block circuit diagram of a first preferred control arrangement for an agitator mill in accordance with the invention, FIG. 6 a second embodiment of a preferred control arrangement for an agitator mill in accordance with the invention, FIG. 7 a third embodiment of a preferred control arrangement for an agitator mill in accordance with the invention, FIG. 8 a schematic illustration of an agitator mill illustrating the limitation of the speed and power of the stirrer motor, and FIG. 9 a further embodiment of the invention which operates using a computer.

Turning firstly to FIG. 1 there is shown an agitator mill in the form of a stirrer ball mill. the agitator mill has a milling vessel 11 and a rotor member 22 of the stirrer (or agitation) mechanism is arranged within the milling vessel for rotation about a vertical axis. An electric motor 28 is provided for driving the stirrer mechanism and is connected to the rotor via V-belts 38. The dispersion or suspension to be processed is sucked by pump 41 from a tank 40. The pump 41 is driven by an associated electric motor 42 and forces the liquid containing the material to be milled into the milling vessel from below. The milling vessel is filled with freely movable milling bodies in the manner shown. These milling bodies are conveniently in the form of balls or spheres 43 as is well known per se in the art. The liquid containing the material to be treated flows into the milling vessel 11 upwardly past the rotor 22 and emerges through openings in a separating wall 44 where it is separated from the milling bodies 43. Finally the liquid containing the milled material flows out of an outlet 45 and is discharged for further processing or subsequent use.

A cooling system is provided and comprises a rotor cooling circuit 21*b* and a stator cooling circuit 21*a*. The cooling medium, which is for example in the form of water is drawn from the mains supply 20 and is supplied via a pressure reducing valve 19 to a magnetic control valve 18. Downstream of the magnetic control valve 18 the cooling flow divides into two branches of which one is passed via a restrictor 24 to the upper end of the milling vessel whilst the other branch passes via a restrictor 25 to the inside of the rotor. The cooling medium leaves the mill via the outlets at 21*c* and 21*d*.

The magnetic control valve 18 is controlled via a temperature controller 17 which receives as input quantities the actual temperature Ti measured by a temperature sensor 16 at the outlet 45 and a desired temperature Ts which can for example be set by hand. The temperature controller 17 forms from these two signals a difference signal which closes the magnetic control valve 18 when the actual temperature Ti is too low and opens the valve further when the actual temperature is too high.

The restrictors 24, 25 are so adjusted relative to one another that the correct quantities of coolant are passed to each of the cooling circuits 21*a*, 21*b*.

A further control circuit is illustrated in broken lines and makes it possible to regulate the temperature difference between the two cooling circuits 21*a* and 21*b* to remain at a constant value. By way of example the outlet temperatures of the two cooling circuits as measured at 21*c* and 21*d* can be controlled to be at the same value.

For this purpose temperature sensors 16' and 16'' are arranged at the outlets 21*d* and 21*c* of the two cooling circuits. The temperatures T1, T2 at the outlets from the cooling circuits are signalled from the temperature sensors to a temperature difference controller 26 to which in addition is passed as a third input quantity the desired value Td for the temperature difference.

A signal appears at the output of the temperature difference controller which corresponds to the difference between the signal Td and the difference of the signals T1, T2. This signal controls a second magnetic control valve 23 which is introduced into the cooling circuit 21*a* in place of the restrictor 24. This valve thus regulates the temperature difference (T1–T2) to a constant value.

A control circuit 13 for the current for the electric motor for driving the stirrer mechanism, hereinafter referred to as the stirrer motor, is arranged between the pump motor 42 and the stirrer motor 28 as can be seen in broken lines in FIG. 1.

Turning now to FIG. 2 there can be seen in detail the volume controller by means of which the filling of the milling vessel 11 with milling bodies 43 can be controlled. For the sake of simplicity the cooling system shown in detail in FIG. 1 is not fully reproduced in FIG. 2 but is restricted only to certain important integers thereof. The liquid containing the material to be milled is once more sucked out of the tank 40 by the pump 41 which is driven from the pump motor 42 and is introduced from below into the milling vessel 11. After rising through the bed of milling bodies 43 the liquid leaves the agitator mill via the outlet 45.

The pump is conveniently a rotary pump and in this case references to the pump speed will be understood to mean the rotational speed of the pump.

In accordance with the invention the base of the milling vessel 11 is formed as a displacement piston 46 which is connected with a drive piston 48 via a piston rod 47. The piston 48 operates in a cylinder 49 with a vertically disposed axis. The cylinder 49 is fixedly connected to the milling vessel 11.

The total volume of the milling vessel 11 can be changed by means of the displacement piston 46. The total volume is constituted by the working volume in the vicinity of the rotor 22 and the passive volume beneath the rotor 22. The milling bodies 43 which are withdrawn from the working volume remain at rest in the passive volume as the effect of the rotor 22 does not extend downwardly into the passive volume. For the sake of easy reproduction the milling bodies which are otherwise also referred to as crusher or grinding bodies are shown to a larger scale then the rest of the apparatus so as to simplify the drawing. In reality the diameter of the milling bodies is mostly smaller than 2.5 millimeters.

When used in the following parts of the description the expression "volume of the milling vessel" will be understood to mean the "total volume".

The movement of the drive piston 48 is transmitted via a cable run 50 to a rotational potentiometer 51. At the lower end of the cable run 50 there is arranged a counterweight 52 or a spring which exercises a stensile force on the cable. The potentiometer 51 is proportionally adjusted in dependence on the up and down displacement of the drive piston 48 via the cable run 50. A voltage representative of the actual position of the drive piston 48 is thus available at the output of the potentiometer 51 and is applied to one input of a volume controller 53.

In accordance with the invention a hydraulic liquid is present in the cylindrical chamber 54 which is located beneath the piston 46 and which is sealed from the outside. A likewise sealed upper cylindrical chamber 55 of the lower cylinder 49 is filled with gas. The piston rod 47 is sealingly guided through the intermediate wall 56 between the two cylinders 49 and 57. The cylindrical chamber 55 is connected via a switch-over valve 58 to a source of pressurized air 59. The gas pressure thus presses downwardly on the drive piston 48 with appropriate positioning of the switch-over valve 58. The lower cylindrical chamber 54 of the upper cylinder 57 is in contrast connected via a magnetic control valve 60 to a pressure balance chamber 61. Pressure balance chamber 61 has its bottom part filled with hydraulic liquid and its upper part filled with gas. The gas chamber is likewise connected at its upper end to the source of pressurised air 59 via a further switch over valve 62. The magnetic control valve 60 is controlled by the output of the volume controller 53 to which, in addition to the signal delivered from the potentiometer 51 which is representative of the actual piston position $V_i$, there is also supplied a desired value signal $V_s$ for the desired volume. This value can either be a fixed value which is set by hand or a value delivered by a distributor 32 which is a component of the control circuit 13 which has yet to be described.

As seen in FIG. 2 the valves 58 and 62 are shown illustrated in the position for automatic control. To the extent that the actual value $V_i$ exceeds the desired value $V_s$, i.e. when the volume of said milling vessel is too large, the magnetic control valve 60 opens until the volume of the milling vessel is reduced to the desired value. Finally the magnetic control valve closes to the extent that the predetermined volume is maintained. Should the actual volume $V_i$ fall below the desired value $V_s$ then the control valve 60 opens once more and once more displaces the piston 46 downward by a certain amount.

Should the piston 46, for example on starting up of the apparatus, be brought into its lowest position then both valves 58, 62 are de-controlled whereby the pressure of the source 59 is applied to the gas space 55. As the magnetic control valve 60 is open in this condition the piston 46 is displaced slowly downwardly whilst displacing hydraulic fluid into the balance tank 61. The filling of the cylindrical chamber 45 with liquid and the cylindrical chamber 55 with gas is important for the invention. In this way an exact desired vertical position of the piston 46 can be accurately maintained.

FIG. 3 illustrates a further possibility for forming the signal representative of the actual volume. In this embodiment the piston rod 47 is of hollow construction so that a linear sliding potentiometer 63 can be housed within the piston rod. The slider 64 is connected for displacement together with the piston 46. The signal representative of the actual volume of the milling vessel is designated $V_i$.

Finally, as shown in FIG. 4, the pressure balance tank 61 can also be used to form the signal $V_i$ representative of the actual volume present in the milling vessel. This can be achieved by housing a vertically extending level sensor 65 in the inside of the pressure balance tank. As shown in FIG. 4 an electrical signal is delivered by the measuring head 66 arranged at the top of the tank which corresponds to the level of the liquid surface 67 in the pressure balance tank 61. The actual value $V_i$ for the volume is also in this case once more passed to the one control input of the volume controller 53.

In the embodiment shown in FIG. 4*a* both the upper cylinder chamber 54 and also the lower cylinder chamber 55 are filled with a pressurised fluid. The two cylinder chambers are respectively connected via ducts 54' and 55' with the two outputs of an electric servovalve 60' the two inputs to which are respectively and interchangeably connectable to a source of pressure 59, such as a pump, and a return flow tank 59'. An accumulator 61 or pressure reservoir is introduced in the path from the pump 59 to the valve 60'.

In other respects the embodiment corresponds to the arrangement shown in FIG. 2.

When the servovalve 60' is in its central position the position of the piston 46 remains unchanged. Should the volume controller 53 signal that too large a volume is present then the servovalve 60' switches in the upward direction whereupon the pressure source 59 is connected to the upper cylindrical chamber 54 and the return circuit 59' is connected to the lower cylindrical chamber 55. As soon as the actual volume $V_i$ has reached the desired volume $V_s$ the volume controller 53 switches the valve 60' once more into a central position.

If too small a volume is present in the milling vessel 11 the valve 60' is switched into the lower position shown in FIG. 4*a* in which the lower cylindrical chamber 55 is connected with the pressure source 59 and the upper cylindrical chamber 54 is connected to the return circuit 59'. The volume in now enlarged until the actual valve $V_i$ is once more the same as the desired value $V_s$. The purely hydraulic piston drive of FIG. 4*a* with the electric servovalve 60' is particularly suitable for continuous control of the position of the piston 46 as shown in FIGS. 6 and 7.

Whilst only details of the agitator mill of the present invention are illustrated in the previous figures, FIG. 5 reproduces in block circuit diagram form a first practical embodiment of a complete control arrangement. As seen in this figure the agitator mill has a temperature control circuit 12 and a primary stirrer motor control circuit 13.

The temperature control circuit 12 included the temperature sensor 16 already illustrated in FIGS. 1 and 2. The electrical signal from this sensor which represents the temperature at the output of the milling vessel is passed as the actual temperature signal T; to one control input of a temperature controller 17. In addition a desired temperature signal $T_s$ is applied to the temperature controller 17 and can for example be adjusted by hand. The output of the temperature controller 17 is connected to the temperature control valve 18 which, depending on its degree of opening, controls the flow of cooling water W to the cooler 21. The cooler 21 is arranged in the manner discussed in connection with FIG. 1 at the milling vessel 11 and/or the rotor 22 of the stirrer. The temperature control circuit 12 allows the temperature in the milling vessel 11 and/or at the rotor 22 to be held within narrow limits at the desired temperature $T_s$.

The rotor 22 which is arranged in the milling vessel 11 is driven via clutch 27 from the stirrer motor 28. Inside the stirrer motor current control circuit 13 the stirrer motor current $I_r$ is passed as an input quantity to a stirrer motor current controller 29. The other input quantity for the stirrer motor current controller 29 is the desired value $I_s$ for the stirrer motor current. The output signal of the stirrer motor current controller 29 which is representative of the deviation of the actual current $I_r$ from the desired current $I_s$ is applied via a comparator 68 to a pump speed controller 30 which controls the rotational speed of the pump motor 42 via a pump motor current controller 69. If the stirrer motor current $I_r$ increases above the normally provided level the pump speed controller 30 will reduce the speed of the pump 41 for a sufficient time until the stirrer motor current $I_r$ once more reaches the desired value $I_s$ and vice versa.

In order however to reliably avoid excess rotational speed of the pump 41 the pump speed controller 30 is also supplied with a maximum speed signal Nm which ensures that the rotational speed of the pump 41 cannot exceed a maximum specified value irrespective of the stirrer motor current $I_r$. For this purpose a signal $N_i$ representative of the actual value of the speed of the pump is passed as a further input to the pump speed controller 30. A continuous comparison is thus also made in the pump speed controller 30 between the signals Nm and $N_i$.

Apart from the pump speed control circuit 14 there is also provided a pump motor current control circuit 15 in which a signal $M_i$ representative of the actual value of the pump motor current and a signal Mm representative of the maximum permissable pump motor current are passed to a pump motor current controller 69. In this way the pump motor current controller 69 limits the pump motor current to the maximum value Mm.

This can, for example, be of significance if a large foreign body could reach the pump and bring it and the motor 42 to a standstill. The current control of the pump motor is however particularly useful during start up when using high viscosity products at low temperatures. The protection of pump motor and pump against blockage is a second line of defence. The pump motor current control circuit 15 thus overrides the pump speed control circuit 14 which in turn overrides the stirrer motor current control circuit 13.

In addition FIG. 5 illustrates the volume control cylinder 57 which as indicated in detail in FIG. 2 is controlled through the magnetic valve 60 to which the hydraulic fluid H is supplied. The value $V_i$ representative of the actual volume in the milling vessel and a signal $V_s$ representative of the desired volume are passed in the manner shown in FIG. 2 to the volume controller 53.

The piston 46 is set at the predetermined desired level by hand adjustment of the desired volume signal $V_s$ and subsequently remains in this position.

Should for some reason or another the capacity of the cooler 21 no longer be sufficient to maintain the desired temperature $T_s$, for example due to the water supply being insufficient or if contamination is present in the cooling system or the temperature of the cooling water is too high the switch 36 closes. On the closing of the switch 36 the temperature controller 17 is additionally connected to a sequence controller 35 which is applied to the other input of the comparator 68. The comparator 68 is so constructed that the temperature difference signal from the temperature controller 17 overrides the stirrer motor current difference signal from the stirrer motor current controller 29 so that the speed of the pump 41 reduces independently of the stirrer motor control current I if the temperature $T_i$ exceeds the desired value $T_s$ despite the maximum available cooling. In this manner, independently from the cooling system or indeed if the cooling system should completely fail overheating of the material to be milled is effectively avoided.

In the exemplary embodiment of FIG. 6 the temperature control circuit 12 does not differ from the control arrangement of FIG. 5. In contrast to FIG. 5 however the stirrer motor current $I_r$ is not held constant by way of the regulation of the pump speed but rather by way of the volume controller 53 to which is passed in addition to the actual value signal $V_i$ also the stirrer motor current difference signal via the comparator 68. In addition a signal Vm representative of the maximum volume can also be passed to the volume controller 53 which limits the maximum value of the volume within the milling vessel.

In this embodiment the speed of the pump 41 is determined by a pressure controller 33 to which the actual pressure pi at the output of the pump 41 or at the input of the milling vessel 11 and a desired pressure signal ps are supplied as input quantities. A control signal corresponding to the difference of these two input values is thus present at the output from the pressure controller which is passed via a normally closed switch 34 to the pump speed controller 30. The pump speed is in this way automatically so adjusted that the pressure at the output of the pump is held constant whereby the speed of the pump 41 and the pump motor current are once more respectively limited to the maximum values Nm and Mm.

In accordance with the invention a change-over switch 34, 34' can be provided between the pressure controller 33 and the pump speed controller 30 by means of which it is possible to switch off the pressure controller from the pump speed controller 30 and instead to apply a desired speed signal $N_s$ via the switch part 34' to the pump speed controller 30. In this case the pump 41 would be controlled to run at constant speed.

If, in the embodiment of FIG. 6, the cooling system should fail or be overloaded the difference signal from the temperature controller 12 is passed via the switch 36 and the sequence controller 35 to the second input of the comparator 68. In this arrangement the temperature difference signal thus has the effect that it overrides the input of the current controller 29 and sets the volume of the milling vessel at its largest value for the sufficient period of time until the desired temperature $T_s$ is achieved (too high a temperature requires a larger volume in the milling vessel). Only when the desired temperature is achieved does the stirrer motor current control come into effect.

In the control arrangement shown in FIG. 7 the temperature control circuit 12 is also formed as in the previous exemplary embodiments. In distinction to these however the stirrer motor current control takes place in the stirrer motor current control circuit 13 over both the pump pressure and also the volume control. For this purpose the stirrer motor current controller 29 is connected via the comparator 68 to a distributor 32 which distributes the difference signal between the pump pressure controller 33 and the volume controller 53. The construction of the distributor 32 can for example be such that first of all the pump pressure is changed via the pump pressure regulator 33 in order to hold constant the stirrer motor current whilst the volume of the milling vessel remains constant. Only when these changes are no larger sufficient to hold the predetermined stirrer motor control current $I_s$ constant is the volume of the milling vessel also changed by way of the volume controller 53. The control arrangement of FIG. 7 should be regarded as optimum as it contains a maximum of change possibilities for holding the stirring motor current constant.

In case the cooling system should fail the change-over of the switch 36 once more allows the comparator 68 to be activated via the sequence controller 35 in such a way that the stirrer motor control current difference signal is overriden by the temperature difference signal from the controller 12 for sufficient time until the set desired temperature $T_s$ is once more achieved.

FIG. 8 schematically illustrates a further possibility for holding the stirrer speed constant via a frequency changer 31. This circuit can advantageously be used in all the preceding exemplary embodiments. In other words each of the previously described control arrangements should be presumed to operate at constant stirrer motor speed.

In order to be able to operate in accordance with the invention with the significantly more economically available AC asynchronous motors particular measures are required to hold the speed constant. For this purpose the stirrer motor 28 is fed as shown in FIG. 8 via a semiconductor based frequency changer 31 the control frequency $f_1$ of which is determined by a desired speed signal $D_s$ which is applied via a comparator 31 to the frequency transformer 31. The size of the initially set desired speed signal thus determines the speed of the AC asynchronous motor 28. The desired speed $D_s$ can be matched to the material being processed.

As a start up aid a desired power signal $L_s$ is also supplied to the comparator 39 which overrides the desired speed signal on start up of the stirrer motor and ensures a constant power or current supply to the motor 28 during start up. In the final operation the desired speed signal however takes over the control of the motor 28.

FIG. 9 shows in schematic form an agitator mill operating with a computer 71 in accordance with the invention. In this arrangement all the previously described controls are carried out by the coumputer 71. The same reference numerals designate the same parts as in the previous embodiments.

The various actual values of the temperatures of the actual pressure pi measured by the pressure sensor 37, of the actual speed ni of the pump motor 42 determined via the tachometer 70 and also the actual value Vi of the volume are introduced at 74 into the computer 71.

The externally variable desired value signals are introduced into the computer 71 via a peripheral input terminal 72.

The chain dotted lines leaving the computer 71 illustrate the control signals given to the individual motor switches and magnetic valves.

A programming device 73 connected to the computer 71 can specify a predetermined programm sequence.

The reducing mill of FIG. 9 in cooperation with the computer 71 enables all the above described control arrangements to be realized.

Moreover the quotient of product pressure and pump speed can be determined as a measure for the operational viscosity of the product in the mill. On the basis of the quotient it is now possible to continuously calculate desired values for the position of the piston 46 which ensures optimum milling.

In a further embodiment the actual value of the material outlet temperature can be changed within desired boundaries so that for a specified product throughput and a specified volume the optimum stirrer power for the operation is developed.

In a futher embodiment the control amplification of the temperature controller is changed in dependence on the material outlet temperature so that the control amplification is increased with increasing temperature.

In accordance with a further embodiment of the invention the desired values for the various materials are stored in a central monitoring computer 76 (FIG. 9) which operates various mills via the lines 75. On commencing work and in accordance with the invention the peripheral input terminal 72 of each mill is individually set to the corresponding desired values for the material from the central monitoring computer 76 instead of by hand. This can be done by simply typing in the mill and material product numbers.

It is finally also important to mention that the desired and actual temperature value signals are passed to the sequence controller 35 of FIGS. 5 to 7 so that the sequence control is first started when the actual temperature is distinguished by a predetermined level from the desired value $T_s$. This is expressed schematically in FIGS. 5 to 7 by corresponding arrows at the sequence controller 35.

For various products the necessary highest desired values for the stirrer motor current must be previously determined from practice and set in the machine. The sequence controller 35 offers in this connection an additional safety in that on reaching the limiting cooler capacity it automatically takes over the control of the material pump 41 independently from how high the desired value of the stirrer motor current has been set.

In accordance with the invention the temperature control circuit and the stirrer motor current control circuit are thus coupled over a significant part of their control region. The stirrer motor current control also makes it possible to better optimise the temperature controller via its control parameter PID.

Moreover it is also possible to control the cooling water supply temperature in place of the material temperature. In cooperation with the stirrer motor current control circuit this arrangement can also achieve a relatively constant product outlet temperature. This solution is advantageous if the temperature control circuit with weak amplification should tend towards instability.

In place of the speed control of the pump 41 a frequency controlled version of the pump drive can also be used. The decisive fact is that the throughput of the pump is controllable.

Finally attention should also be drawn to the fact that an incremental signaller could also be used in place of the potentiometers of FIGS. 2, 3 and 4*a*.

The purpose of the changeable stirrer speed as discussed in connection with FIG. 8 is on the one hand the starting up of the stirrer motor at constant current (no turbocoupling is then necessary) and on the other hand the optimisation of the processes for various material products.

We claim:

1. An agitator mill suitable for treating a liquid including material particles, the agitator mill comprising a milling vessel containing a plurality of freely movable milling bodies and having inlet and outlet means for said liquid, a controllable feed pump for supplying said liquid, a stirrer mechanism having a rotor located within the milling vessel, an electric stirrer motor for driving said stirrer mechanism and a cooling system for the throughflow of coolant to cool the liquid in said vessel, there being further provided a primary control circuit for controlling the stirrer motor current, said primary control circuit including means for comparing the actual value of said stirrer motor current with a desired value thereof and means for adjusting at least one of the speed of the feed pump and the number of milling bodies within the working volume of the milling vessel, whereby to readjust said actual value of the current to a value substantially equal to said desired value thereof, and a secondary control circuit for controlling the temperature of the liquid in the milling vessel, said secondary control circuit including a temperature controller for comparing the actual temperature of the liquid in the milling vessel with a desired temperature thereof and for adjusting said cooling system to increase the cooling when too high an actual temperature is present and to decrease the cooling when two low an actual temperature is present.

2. An agitator mill according to claim 1 further including a temperature sensor located at the outlet of the vessel to determine the actual temperature of the liquid in the milling vessel with said temperature sensor being connected to a first input of said temperature controller, said temperature controller having a second control input for said desired temperature.

3. An agitator mill according to claim 2, said agitator mill further comprising a first control valve, wherein an output signal of the temperature controller actuates the first control valve through which a coolant flows to at least one of the vessel and the rotor of the stirring mechanism.

4. An agitator mill according to claim 3 further comprising separate cooling circuits for both said milling vessel and said rotor and temperature difference control means for automatically regulating a predetermined difference between the cooling of the vessel and of the rotor.

5. An agitator mill according to claim 4 and wherein said temperature difference control means includes a second control valve to provide individual control of the milling vessel cooling circuit and the rotor cooling circuit and a temperature difference controller which receives as inputs the output temperatures of the milling vessel and the rotor cooling circuits and the desired value of the difference between these temperatures, with said second control valve being controlled by an output of said temperature difference controller.

6. An agitator mill according to either claim 1 or 5, said mill further comprising a stirrer motor current controller and a pump speed motor controller, wherein a signal representative of the actual current of the stirrer motor is passed to the stirrer motor current controller, said stirrer motor current controller also receiving a signal representative of the desired motor current, said current controller having an output signal representative of the difference between the actual motor current and the desired motor current, said pump speed controller receiving the output from the current controller and adjusting the speed of the feed pump to hold said stirrer motor current substantially constant at the desired level.

7. An agitator mill according to either claim 1 or 5, said mill further comprising a stirrer motor current controller and a volume controller for adjusting the number of milling bodies within the working volume of the milling vessel, said current controller receiving a first signal representative of the actual current level and a second signal representative of the desired current level and providing an output representative of the difference therebetween, and said volume controller receiving the output from the current controller and adjusting the number of milling bodies within the working volume of the milling vessel to hold said stirrer motor current substantially constant at the desired level.

8. An agitator mill according to claim 7 further comprising a pump speed controller and a distributor means for connecting the output of said stirrer motor current controller to said pump speed controller in addition to said volume controller; whereby said pump speed controller controls the speed of said feed pump so that the stirrer motor current remains substantially at said desired value.

9. An agitator mill according to claim 7, said mill further comprising a pump speed controller and a pressure controller, said pressure controller receiving a first signal representative of the actual pressure prevailing in the milling vessel and a second signal representative of the desired pressure in the milling vessel and producing an output signal representative of the difference between said first and second signals, said pump speed controller receiving said output signal and thereby adjusting the speed of the feed pump.

10. An agitator mill according to claim 1, said mill further comprising a sequence controller, a volume controller and a pump speed controller, wherein the output of the secondary temperature control circuit is connectable via the sequence controller to at least one of the pump speed controller for regulating the speed of said pump, and the volume controller.

11. An agitator mill according to claim 1 wherein the electric motor is an asynchronous AC motor, said mill further comprising a frequency converter for supplying power to said AC asynchronous motor and means for supplying the smaller of a desired speed signal and a desired power signal to said frequency converter.

12. An agitator mill according to claim 1 further comprising a pump speed limiting circuit for limiting the speed of said pump.

13. An agitator mill according to claim 1 further comprising a pump motor current control circuit for limiting the pump motor current to a maximum value.

14. An agitator mill according to claim 1 and wherein all associated control functions are controlled by a computer.

15. An agitator mill in accordance with claim 1 and further including a computer, said computer being adapted to receive as input data the actual and desired values of the control parameters of said agitator mill and being connected to the associated control devices.

16. An agitator mill according to claim 15 and wherein said computer further includes an input facility for writing in of the desired values of the said control parameters.

17. An agitator mill according to claim 16 and wherein said input facility comprises a memory adapted to store the control parameters associated with at least one material product to be treated in said agitator mill.

18. An agitator mill according to claim 1 further comprising a feed pump pressure controller, said pressure controller adjusting the speed of said controllable feed pump, said feed pump pressure controller receiving a first signal representative of the actual pressure prevailing in said milling vessel and a second signal representative of the desired pressure in said milling vessel.

19. An agitator mill according to claim 1 further comprising a feed pump speed controller, a volume controller for varying the number of milling bodies in the working volume of the vessel and means for connecting the output of said temperature controller to at least one of the feed pump speed controller for regulating the speed of said feed pump and said volume controller, whereby additional cooling of the vessel may be achieved.

20. An agitator mill according to claim 19 further comprising a sequence controller for connecting the output of said temperature controller to both said pump speed controller and said volume controller.

21. A method of controlling an agitator mill of the type used for treating a liquid including material particles and comprising a milling vessel having a working volume therein, said vessel containing a plurality of freely movable milling bodies, inlet and outlet means for admitting the liquid to and allowing the liquid to leave the milling vessel, a controllable feed pump for supplying the liquid, a stirrer mechanism located within the milling vessel, an electric stirrer motor for driving the stirrer mechanism, a cooling system for providing a throughflow of coolant, and a volume controller for varying the total volume of the milling vessel, said total volume being related directly to the number of milling bodies within the working volume of the milling vessel, the method comprising the following steps:

(a) monitoring the difference between the actual total volume and the desired total volume of the milling vessel and adjusting the volume controller in response to said monitored difference value whereby to hold the total volume of the milling vessel substantially constant, (b) monitoring the difference between the actual and the desired values of said stirrer motor current and adjusting the throughput of the controllable pump in response to the difference between said actual and desired values of the stirrer motor current whereby to correct for deviations of said stirrer motor current to hold the stirrer motor current substantially constant, (c) simultaneously monitoring the difference between the actual and desired values of the temperature in the milling vessel and adjusting the cooling of the milling vessel to hold the actual temperature substantially constant at said desired temperature and (d) detecting when said actual temperature rises substantially above said desired temperature and, when such a condition occurs, overriding the adjustment made in (step b) to readjust the throughput of the pump and to restore said actual temperature to said desired temperature.

22. A method of controlling an agitator mill in accordance with claim 21 and wherein the step of adjusting the throughput of the pump is achieved by adjusting the speed of the pump and wherein said method comprises the further steps of monitoring the actual value of the speed of said pump and the actual value of the current drawn by the pump driving motor comparing these values with their respective maximum limiting values and overriding the adjustment made in step (b) when either of said limiting values is exceeded.

23. A method of controlling an agitator mill of the type used for treating a liquid including material particles and comprising a milling vessel having a working volume therein, said vessel containing a plurality of freely movable milling bodies, inlet and outlet means for admitting the liquid to and allowing the liquid to leave the milling vessel, a controllable feed pump for supplying the liquid, a stirrer mechanism located within the milling vessel, an electric stirrer motor for driving the stirrer mechanism, a cooling system for providing a throughflow of coolant, and a volume controller for varying the total volume of the milling vessel, said total volume being related directly to the number of milling bodies within the working volume of the milling vessel, the method comprising the following steps:

(a) monitoring the difference between the actual throughput of the pump and the desired throughput of the pump and adjusting the throughput of the pump in response to said monitored difference to hold the throughput of the pump substantially constant, (b) monitoring the difference between the actual and desired values of the stirrer motor current and adjusting the volume controller to correct for deviations of the actual stirrer motor current from the desired value, (c) monitoring the difference between the actual and desired operating temperature of the mill and controlling the throughflow of coolant in response to said monitored difference whereby to hold the operating temperature of the mill substantially constant, and (d) detecting when the actual operating temperature of the mill exceeds said desired operating temperature of the mill and overriding the signal from step (b) to adjust the volume controller to restore said actual temperature of said desired temperature.

24. A method of controlling an agitator mill in accordance with claim 23 and wherein the step of monitoring the throughput of the pump is achieved by monitoring the pressure at the outlet of the pump and comparing this outlet pressure with a desired pressure signal.

25. A method of controlling an agitator mill in accordance with claim 14 and comprising the further steps of monitoring the speed of the pump and the current drawn by the pump motor, comparing these values with limiting values therefore and overriding the signal controlling the throughput of the pump if either of said limiting values are exceeded.

26. A method of controlling an agitator mill in accordance with claim 23 and where the step of controlling the throughput of the pump is achieved by controlling the speed of operation of the pump.

27. A method of controlling an agitator mill according to claim 26 and comprising the further step of monitoring the speed of the pump and the current drawn by the pump motor, comparing these values with maximum limiting values and overriding the throughput control signal to the pump if either of said limiting values is exceeded.

28. A method of controlling an agitator mill of the type used for treating a liquid including material particles and comprising a milling vessel having a working volume therein, said vessel containing a plurality of freely movable milling bodies, inlet and outlet means for admitting the liquid to and allowing the liquid to leave the milling vessel, a feed pump for supplying the liquid, a feed pump speed controller for controlling the flowrate of liquid, a stirrer mechanism located within the working volume of the milling vessel, an electric stirrer motor for driving the stirrer mechanism, a cooling system for providing a throughflow of coolant, and a volume controller for varying the total volume of the milling vessel, said total volume being related directly to the number of milling bodies within the working volume of the milling vessel, the method comprising the following steps:

(a) monitoring the difference between the actual and the desired values of the stirrer motor current, (b) deriving a control signal related to the difference between the actual stirrer motor current and the desired value, (c) passing said signal to the feed pump speed controller whereby to adjust the flowrate of the pump and to correct for deviations of said stirrer motor current from said desired value, (d) monitoring the difference between the actual and desired total volume of the milling vessel and adjusting the volume controller to hold said total volume substantially constant, (e) detecting when the value of the stirrer motor current substantially exceeds the desired value thereof, (f) overriding the adjustment made in step (d) to increase the total volume and thus reduce the number of milling bodies in the working volume and thus to hold the stirrer motor current substantially constant when the condition in step (e) exists, (g) monitoring the difference between the actual and desired values of the operating temperature of the mill and controlling the cooling of the milling vessel to hold the actual operating temperature of the mill substantially constant at said desired value, (h) detecting when the actual operating temperature of the mill substantially exceeds the desired temperature and (i) overriding the control signal derived from the stirrer motor current until said actual temperature is restored to said desired temperature.

29. A method of controlling an agitator mill in accordance with claim 28 and wherein the step of controlling the throughput of the pump is achieved by controlling the output pressure of the pump.

30. A method of controlling an agitator mill in accordance with claim 28 and comprising the further steps of monitoring the speed of the pump and the current drawn by the pump motor comparing these values with maximum limiting values and overriding the pump control if either of said desired values is exceeded.

31. A method of controlling an agitator mill in accordance with claim 28 and comprising the further step of comparing the actual volume of the milling vessel with a maximum permissible volume thereof and overriding the volume control signal when the actual volume reaches the maximum permissible volume.

* * * * *